US007647976B2

(12) United States Patent
Tsilevich

(10) Patent No.: US 7,647,976 B2
(45) Date of Patent: Jan. 19, 2010

(54) SYSTEM AND METHOD FOR STEAM-ASSISTED GRAVITY DRAINAGE (SAGD)-BASED HEAVY OIL WELL PRODUCTION

(76) Inventor: Maoz Betzer Tsilevich, 640 Woodbine Blvd., Woodbine, Southwest Calgary, Alberta (CA) T2W 4W4

( * ) Notice: Subject to any disclaimer, the term of this patent is extended or adjusted under 35 U.S.C. 154(b) by 327 days.

(21) Appl. No.: 11/408,117

(22) Filed: Apr. 21, 2006

(65) Prior Publication Data

US 2008/0000644 A1 Jan. 3, 2008

(51) Int. Cl.
*E21B 43/24* (2006.01)

(52) U.S. Cl. ..... 166/379; 166/303; 166/52; 166/272.3

(58) Field of Classification Search ..... 166/303, 166/52, 901, 272.1, 272.3, 379, 366; 405/196, 405/201, 202, 195.1
See application file for complete search history.

(56) References Cited

U.S. PATENT DOCUMENTS

2005/0145388 A1* 7/2005 Hopper ..... 166/357

* cited by examiner

*Primary Examiner*—Jennifer H Gay
*Assistant Examiner*—Robert E Fuller
(74) *Attorney, Agent, or Firm*—Egbert Law Offices PLLC

(57) ABSTRACT

A system for steam-assisted gravity drainage for heavy oil production has a first well, a second well, a first platform connected to the well head of the first well so as to inject steam into the first well, and a second platform connected to the well head of the second well for producing heavy oil from the second well. The platforms are arranged in parallel flow relationship. Each of the platform has a first level with flow lines extending longitudinally therealong and a second level located above the first level and having piping connected to the flow lines of the first level. The second level includes valves and controllers cooperative with the piping. The platforms are modular in nature and can be connected to other platforms.

17 Claims, 12 Drawing Sheets

SYSTEM AND METHOD FOR STEAM-ASSISTED GRAVITY DRAINAGE (SAGD)-BASED HEAVY OIL WELL PRODUCTION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to methods and systems for producing crude oil from a reservoir of heavy oil or bitumen by steam-assisted gravity drainage (SAGD) processes. More particularly, the present invention relates to the injection, for production and gather systems, of field wells by using basic block units as a building block that could be installed with minimal cost and minimal on-site labor. More particularly, the present invention relates to modular systems that can be employed in such SAGD processes.

2. Description of Related Art Including Information Disclosed Under 37 CFR 1.97 and 37 CFR 1.98

Heavy oil reservoirs contain crude petroleum having a API gravity less than about 10 which is unable to flow from the reservoir by normal natural drive primary recovery methods. These reservoirs are quite difficult to produce. The tar sand deposits in Canada are typically heavy oil deposits that cannot be produced by standard technology. The steam-assisted gravity drainage (SAGD) process is commonly used to produce heavy oil and bitumen reservoirs. This generally includes the injection of steam, sometimes with a solvent, into an upper horizontal well through the reservoir to generate a steam that heats the petroleum to reduce the viscosity and make it flowable. Production of the heavy oil or bitumen is from a lower horizontal well through the reservoir disposed below the upper horizontal well. The SAGD and its further developing technology requires a significant amount of equipment. This equipment includes piping, valves, insulation, tracing, and electric instrumentation that is concentrated at the location of the well. Another typical characteristic of the SAGD is the close proximately of the injection and the production wells. A group of injection and production wells are gathered together on a certain location to produce a certain underground deposit. This complex of wells is typically defined as a pad.

The SAGD development over the years has concentrated on the process itself and especially on the underground portion of the process. However, because of the locations and the general conditions, especially in Alberta oil sands, the cost of the constructed facility and the scheduling risk are playing an increasing role.

The heavy oil or bitumen produced by the SAGD and similar methods require large amounts of steam generated and injected to the oil sand deposit. The heavy oil or bitumen has a very high viscosity that makes it difficult to transport and store. It must be kept at an elevated temperature and/or is sometimes mixed with a lighter hydrocarbon diluent for pipeline transportation. Because of this, the production wells is complex and contains a significant amount of insulated and heat-traced pipes, control valves and equipment which must be maintained in close proximity to the well heads.

In the past, SAGD oil field were built using the traditional approach of field construction. The flow lines connecting the well heads were connected to the equipment in the field. It is also a common practice to install most of the equipment on skids or modules and to install and connect those units between the wellheads and the flow lines.

The use of platforms in the offshore industry is well known. In the offshore industry, there is a significant importance for the ease of the construction and the method of the construction. An additional factor is that, on an offshore platform, everything must be pre-fabricated in a remote location. For example, U.S. Pat. No. 5,775,846 describes an offshore production platform and method of installing such a platform. U.S. Pat. No. 5,505,151 describes a vessel structure that integrated independent modular units for oil production at sea. The only similarity with the off-shore prior art is the fact that in the offshore cases, the constructed complex, along with the manner in which it is constructed, is a significant economic factor in project planning. As such, oil production is not the only item that drives the economics and feasibility of the oil production project and there is a significant importance to the systems and methods used to construct an off shore projects.

There is an unmet need in the art for a way to reduce the cost of SAGD construction. There is also a need to reduce scheduling risks due to uncontrolled field conditions. It is important to be able to minimize these costs by providing a solution that allows construction to be carried out using a standard basic platform unit that is pre-assembled. These units can be connected to each other so as to build most of the oil production pad, including its pipes and flow lines.

The current SAGD technology typically constructs pads with field constructed flow lines, electrical cables trays and piping. The pipes are connected to the well heads using modules that contain valves, control equipment, electrical equipment and instrumentation. All the connection between the equipment modules to the flow lines is done in the field. A major disadvantage in the manner in which SAGD is currently constructed is the need for significant amount labor to be carried out in the field. This is subjected to high labor costs, environment impacts, and scheduling risks. It is important to minimize and simplify these disadvantages by standardizing work in the shops and the work in the field by producing a standard unit that will includes the flow lines, the piping as well as the equipment all connected together on a transferable platform for the construction of the SAGD.

It is an object of the present invention to provide a system that avoids the need to separately construct and connect pipes in the field.

It is another object of the present invention to provide an assembly that can be easily transported to the desired location.

It is still a further object of the present invention to provide a system for SAGD that can be manufactured off-site.

It is another object of the present invention to provide a system for SAGD which minimizes the costs.

It is still a further object of the present invention to provide a system for SAGD which allows for a shorter construction schedule.

It is a further object of the present invention to provide a system for SAGD that minimizes hydro-testing requirements in the field.

It is still another object of the present invention to provide a system for SAGD that allows for the relocation of equipment after the well is depleted.

It is still a further object of the present invention to provide a system which improves safety for those involved with the assembly, manufacturer and production.

These and other objects and advantages of the present invention will become apparent from the reading of the attached specification and appended claims.

BRIEF SUMMARY OF THE INVENTION

The present invention provides a system and method for a well site complex facility for producing heavy oil or bitumen economically by steam-assisted gravity drainage. This system is particularly applicable if the oil reservoir is in a remote location and subject to extreme weather. The present invention provides the ability to construct the gathering and injection systems in a shop so as to minimize the amount of work on-site. The present invention is designed for locations where the work on-site is expensive and would result in poor productivity or a tight project schedule. The present invention is particularly applicable to the oil sands deposits in north Alberta and Saskatchewan in Canada and possibly in other locations.

The present invention is a system for heavy oil production that comprises a first well having a well head, a second well having a well head, a first means connected to the well head of the first well for injecting steam into the first well, and a second means connected to the well head of the second well for producing heavy oil from the second well. The first and second means are arranged in parallel flow relationships. Each of the first and second means includes a first level having a plurality of flow lines extending therealong so as to be exposed in opposite sides thereof, and a second level located above the first level. The second level has piping connected to the flow lines of the first level. The second level includes valves and controllers that are cooperative with the piping. The second level also includes electrical and communication cables thereon. The piping has a swivel head connection suitable for joining to the well head to accommodate the relative contraction and expansion between the well head and the connections on the basic platform. A walkway can be formed on the second level. A stairway can extend from the first level upwardly to the walkway of second level.

The present invention is also a system for heavy oil production that comprises a first piping assembly having a first level and a second level and a second piping assembly having a first level and a second level. The first level of each of the first and second piping assemblies has a plurality of flow lines extending longitudinally therealong. The second level of the piping thereon is in communication with the flow lines of the first level. The second level is located above the first level. The piping of the second piping assembly is selectively connected to the piping of the first piping assembly. The first basic unit modular platform assembly is joined in end-to-end relationship with the second basic unit modular platform assembly. The second level receive electrical and communication cables therein. The electrical and communication cables of the second level of one of the piping assemblies is connectable to the electrical and communication cables of the second level of the other of the piping assemblies directly or through the first level.

The present invention is also a method of installing piping systems for heavy oil production that comprises the steps of: (1) forming a first basic platform having a first level and second level with flow lines extending along the first level and piping communicating with the flow lines and extending along the second level; (2) forming a second basic platform having a first level and second level with flow lines extending along the first level and piping communicating with the flow lines and extending along the second level; (3) transporting the first and second basic platforms to the oil field site; locating the basic module unit platform parallel to a first and a second well head; (4); and (5) connecting the piping of the second platform to the piping of the first platform. This method also includes the steps of forming a third platform having a first level and a second level with flow lines extending along the first level and piping communicating with the flow lines on the first level, forming a fourth platform having a first level and a second level with flow lines extending along the first level and piping communicating with the flow lines and extending along the second level, transporting the third and fourth platforms in continuation to the first and the second basic platform units and parallel to a third and forth well heads, connecting the third platform to the second well heads, and connecting the piping of the fourth platform to the piping of the third platform. The third and fourth platforms are arranged in continuation parallel flow relationship with respect to the first and second platforms. connecting the first platform basic module to the first well head, the second platform basic module to the second well head and so on until the whole injection and production wells are connected to their basic platform units. The first well head can be a production well. The second wellhead can be an injection well. Cables can be extended along the cable trays so as to allow the cables to be connected with the platforms in end-to-end relationship.

The main difference between the use of a single basic module unit (a production unit and an injection unit) and a double basic module unit (or even a multiple basic module unit) is due to transportation limits. There is an advantage to transport a single basic unit as it is easier and can be done from longer distances using more standard transportation means, however the disadvantages is that it will increase the amount of work on site because there will be double the amount of basic module platform unit to connect on site. On the other hand the use of the double platform (or even a multiple platform) units have site advantages by reducing the amount of work on site but it have transportation limitations that increase the transportation cost and limit the possible off site production shops that can ship those big units to site. The decision to use the single basic unit, the double basic unit or even a multiple basic unit should be done on a specific basis for the specific heavy oil project.

DETAILED DESCRIPTION OF THE INVENTION

Figure 1:
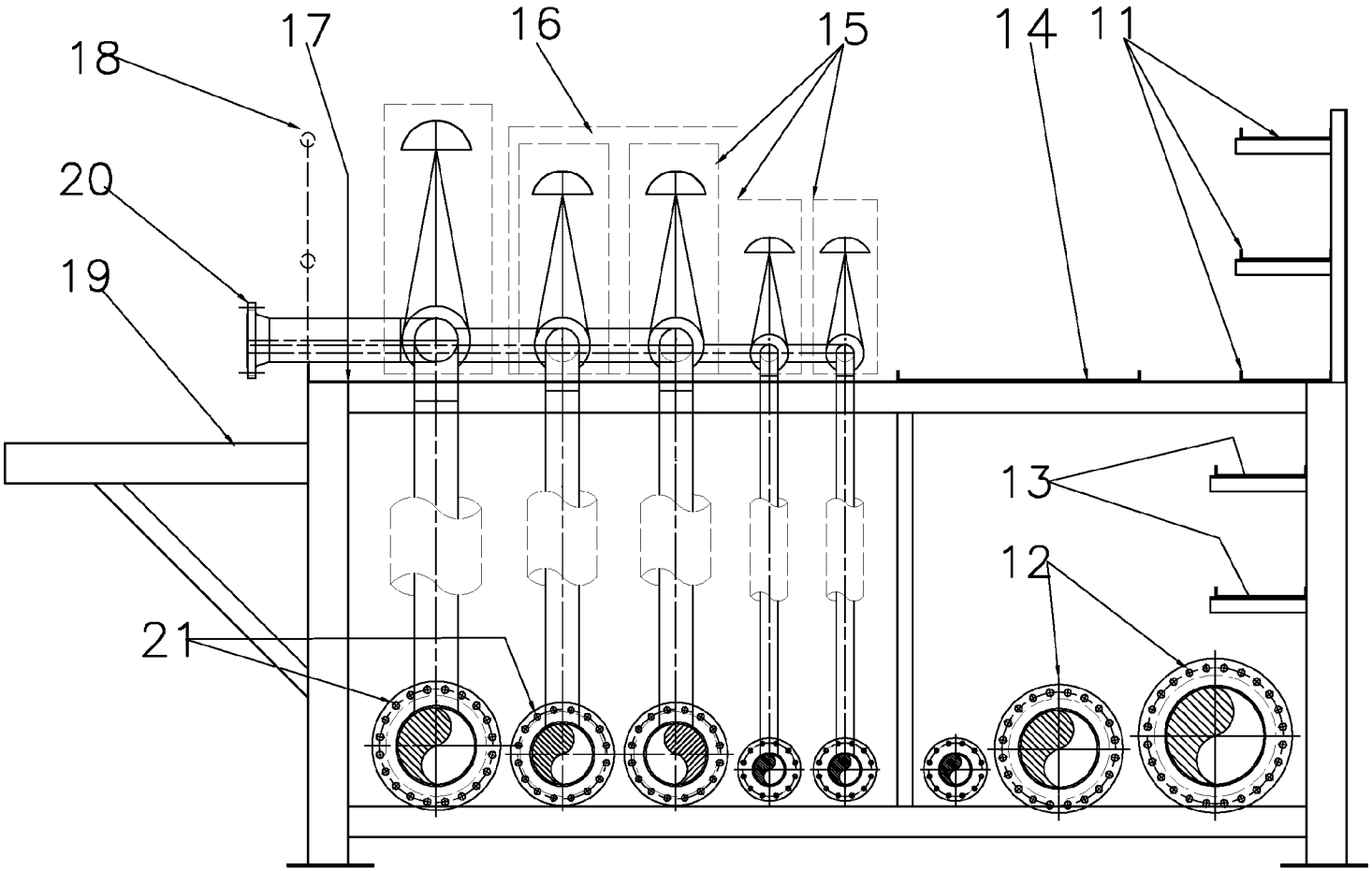
FIG. 1 is a schematic cross-sectional view of the basic platform.

FIG. 1 shows a basic platform unit cross-section viewed from the connection area between two basic platform units. The first level contains the injection and production pipes 21 that are connected to the second level. In additional to that, there is an expansion option for additional flow lines 12 that are not connected to the second level and additional cable trays 13. As such, the platform can serve as a pipe-rack for product which is not connected directly with the wells on the pads. The second level of FIG. 1 shows the cable trays 11 that provide, together with cable trays 13, the electrical and instrumentation connection to the platform. Walkway 14 provides access to the valves, controllers and instrumentation that will serve the platform. The valves, flow controls and instrumentation are located on the second level in designated areas 15 while the electronic instrumentations are located in another designated area 16. The valves, the flow control instrumentation and the electronic instrumentation are accessible by a walkway and a platform 17 on the second level. A safety handrail 18 is protecting the walkway and access to the platform 17. A support structure 19 is located in front of the flanges 20 to support the connection spools that connect the flanges located on the second level edge and the wells.

Figure 8:
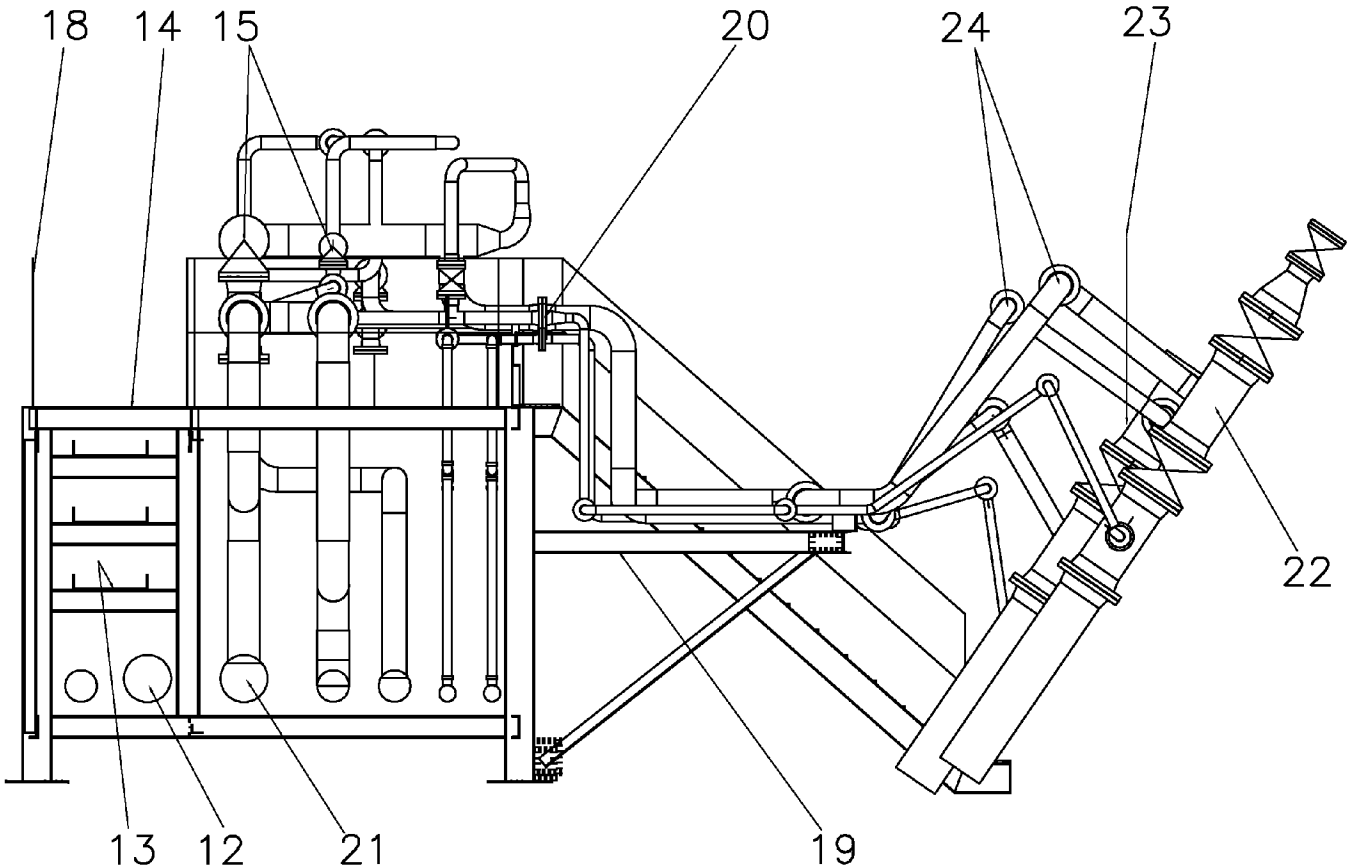
FIG. 8 is a cross-section view of the basic platform connected to a typical SAGD injection and production wells.

FIG. 8 shows a basic platform unit cross-section viewed from the connection area shown in FIG. 1 between two basic platform units with the connection to the injection and production well heads. The first level contains the injection and production pipes 21 that are connected to the second level. In additional to that, there is an expansion option for additional flow lines 12 that are not connected to the second level and additional cable trays 13. The second level of FIG. 8 shows walkway 14 to provide access to the valves, controllers and instrumentation that will serve the platform. The valves, flow controls and instrumentation 15 are located on the second level. A safety handrail 18 is protecting the walkway and access to the platform 14. A support structure 19 is located in front of the flanges 20 to support the flexible connection spools 24 that connect the steam line to the steam injection well 23 and the production line to the production well 22.

Figure 2A:
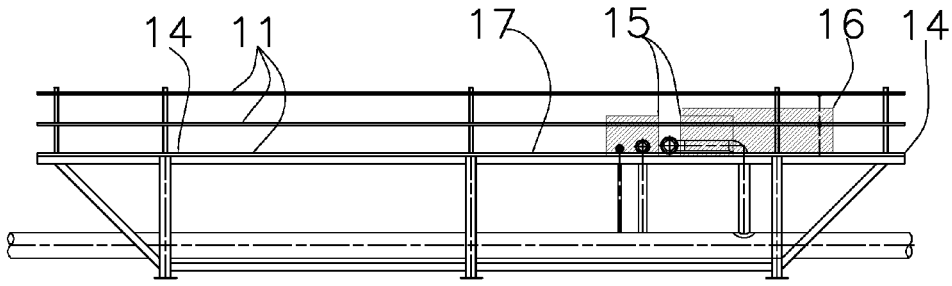
FIG. 2A and FIG. 2B are a side elevation view and top plan view, respectively, of a standard platform for pairs of wells.
Figure 2B:
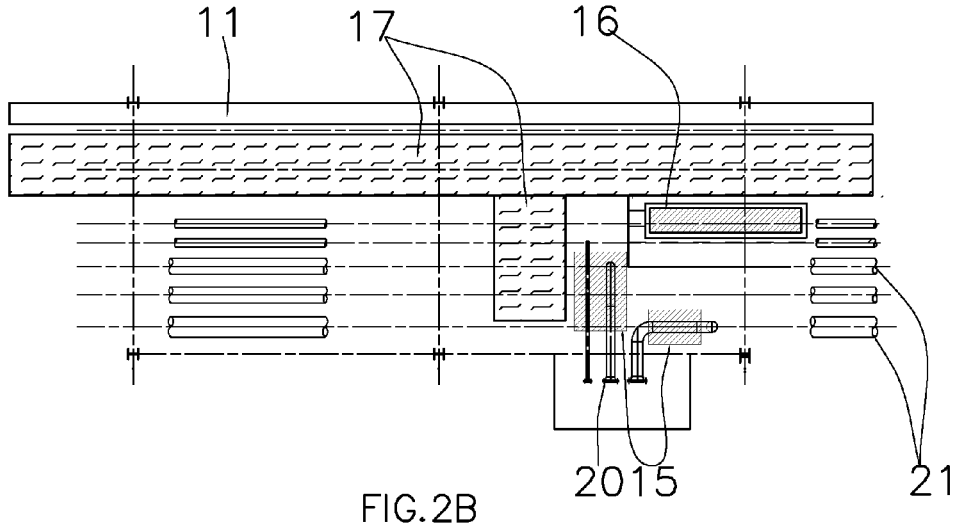

FIG. 2A shows a side view of the basic injector platform of the present invention. In FIG. 2B, the injection pipes 21 are connected to the second level where the instrumentation and flow control equipment 15 is located.

Figure 3A:
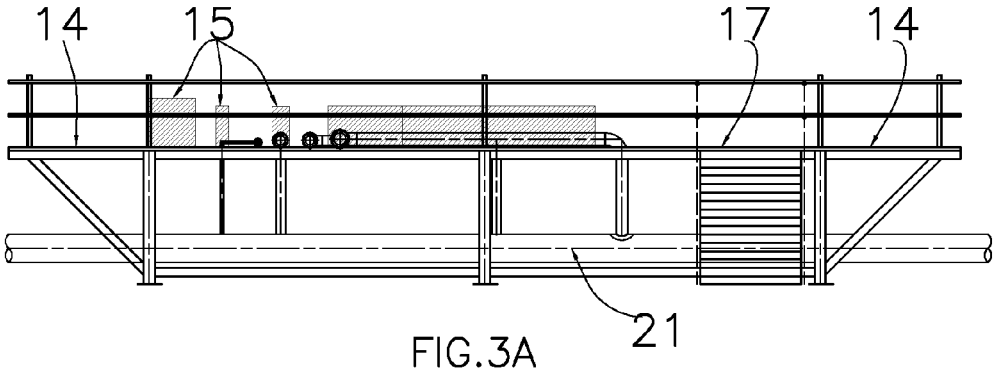
FIG. 3A and FIG. 3B are another side elevation view and top plan view, respectively, of the basic platform for a single steam injection well.
Figure 3B:
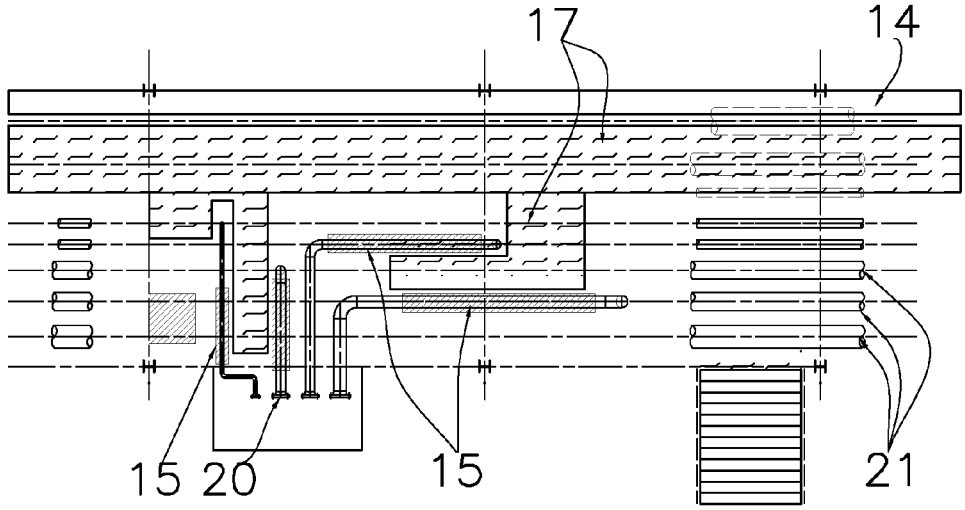

FIG. 3A shows a side view of the basic producer platform of the present invention. In FIG. 3B, the production pipes 21 are connected to the second level where the instrumentation and flow control equipment 15 is located. A stairs allows access to the second level platform.

Figure 4A:
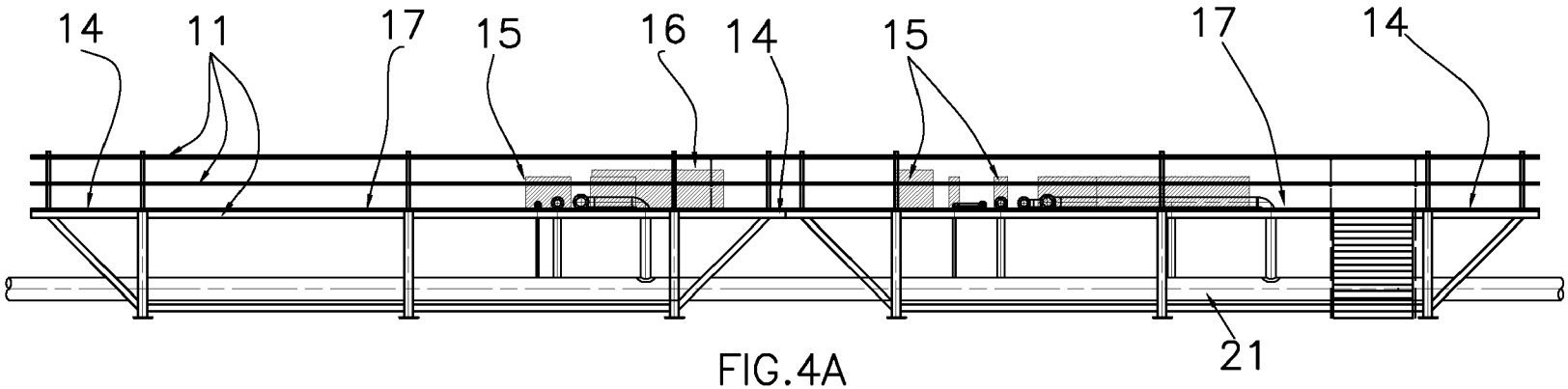
FIG. 4A and FIG. 4B are still another side elevation view and top plan view, respectively, of the basic platform for a single heavy oil production well, indicating the isolated views of FIGS. 2A and 3A.

FIG. 4A, a side view of the connection when installed on site between a basic producer platform module and a basic injection platform module. A stairs allows access to the second level platform as shown in FIG. 4B.

Figure 5A:
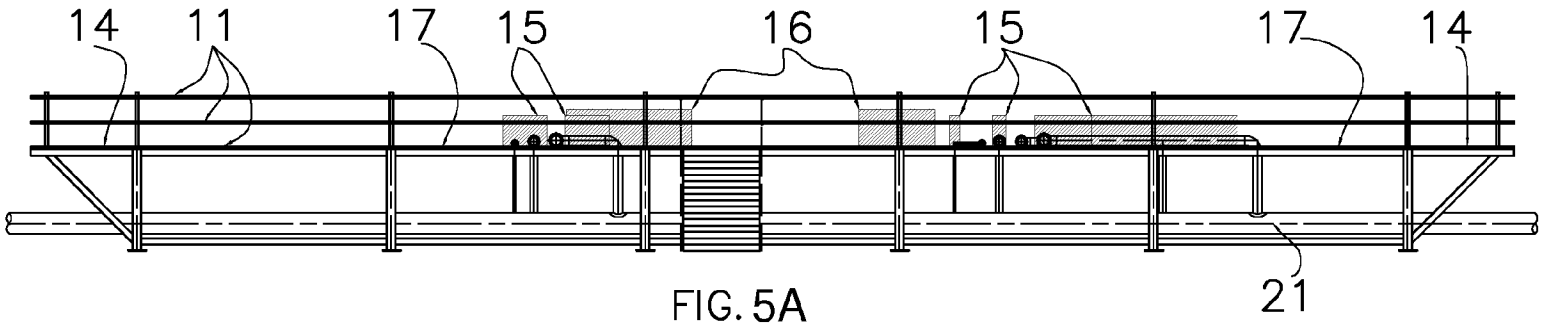
FIG. 5A and FIG. 5B are another side elevation view and top plan view, respectively, of the connection of two basic oil production and steam injection single platforms after they installed in the oil field.
Figure 5B:
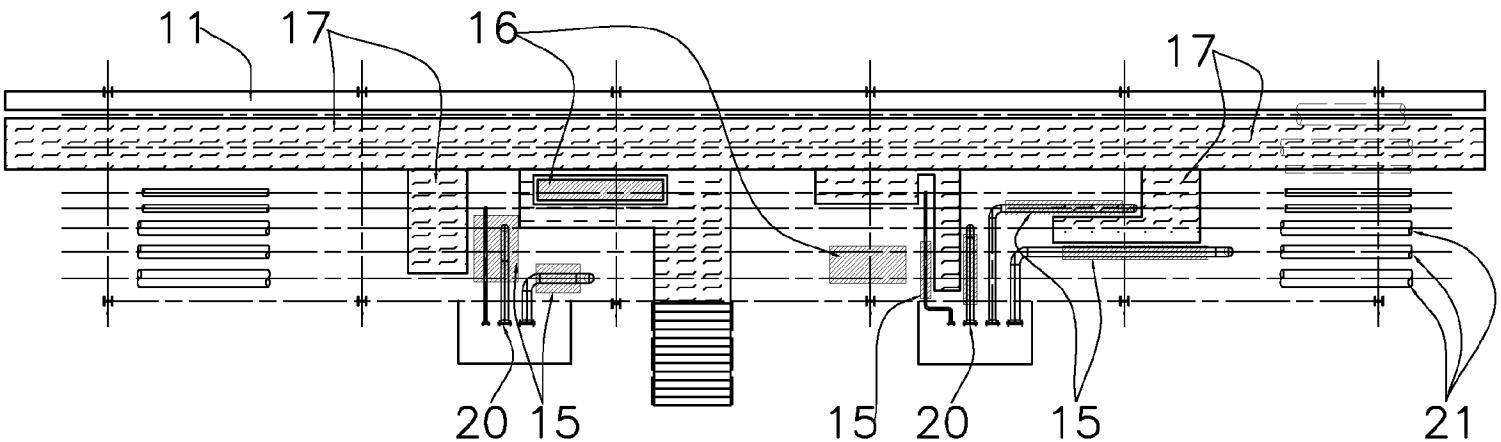

FIG. 5A shows a side view of the basic double platform of the present invention. This double unit is construct at the shop and shipped to site as double unit contained an injector and producer units. In FIG. 5B, the injection and producing pipes 21 are connected to the second level where the instrumentation and flow control equipment 15 is located.

Figure 9:
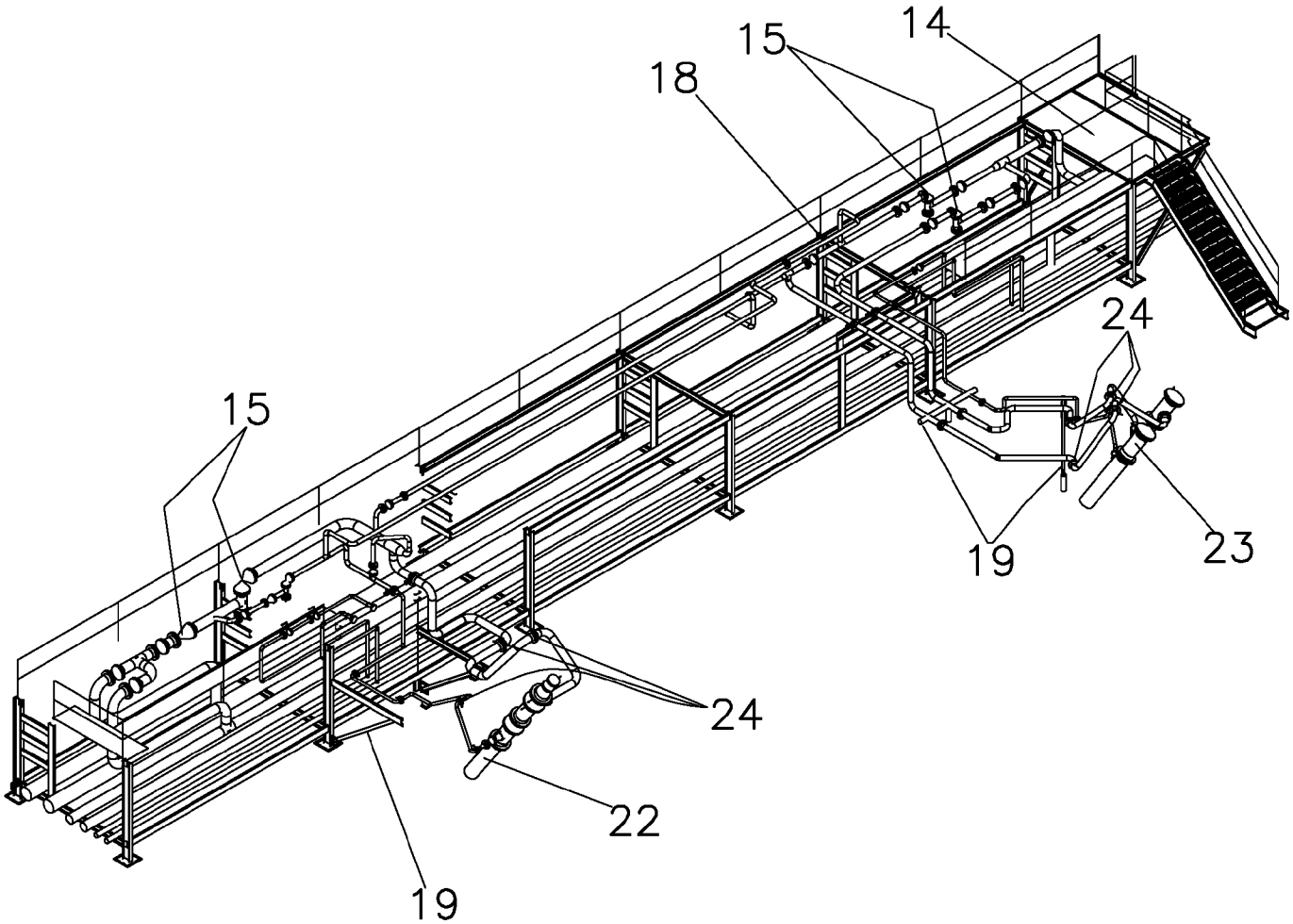
FIG. 9 is an isometric view of the basic platform connected to a typical SAGD injection and production wells.

FIG. 9 shows an isometric view of the basic platform like the one described in FIGS. 3A through 4B with its connections to a typical SAGD injection and production wells. The injection well 23 and the production well 22 are connected using flexible joints to the platform to compensate for any relative movement during start-up and operation of the unit. The flexible joints includes swivels 24 and are supported on steel supports 19. The valves, flow equipment and instrumentation in area 15 are at the second level with an easy access from the platform and walk-way 14. Stairs can be installed on each unit to allow an easy access and egress to the second level platform.

Figure 4B:
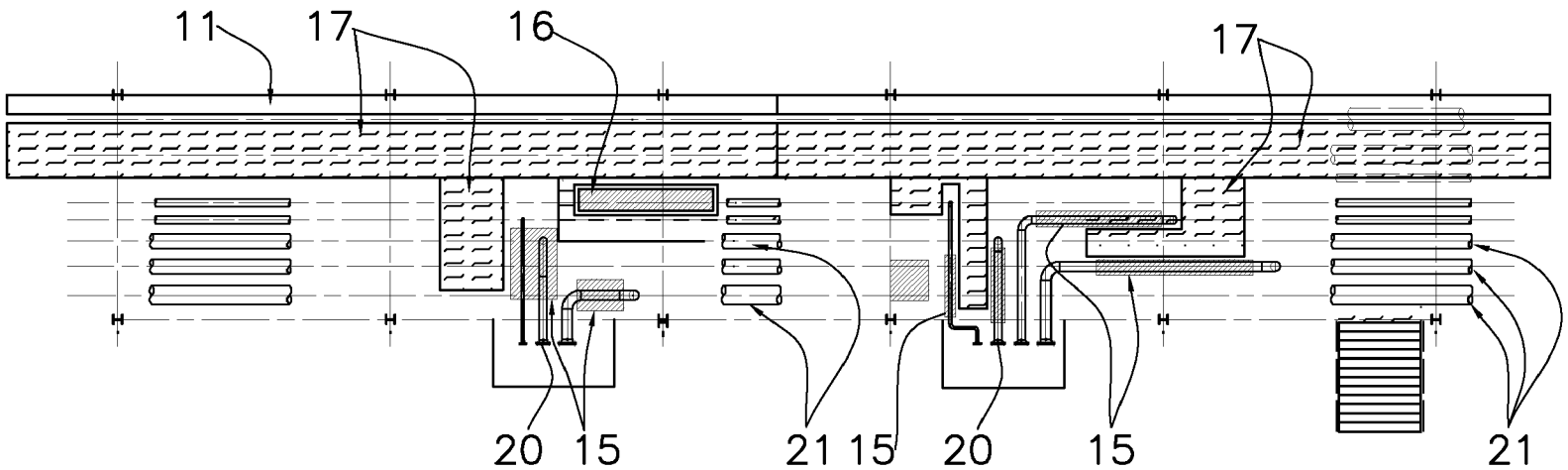
Figure 10:
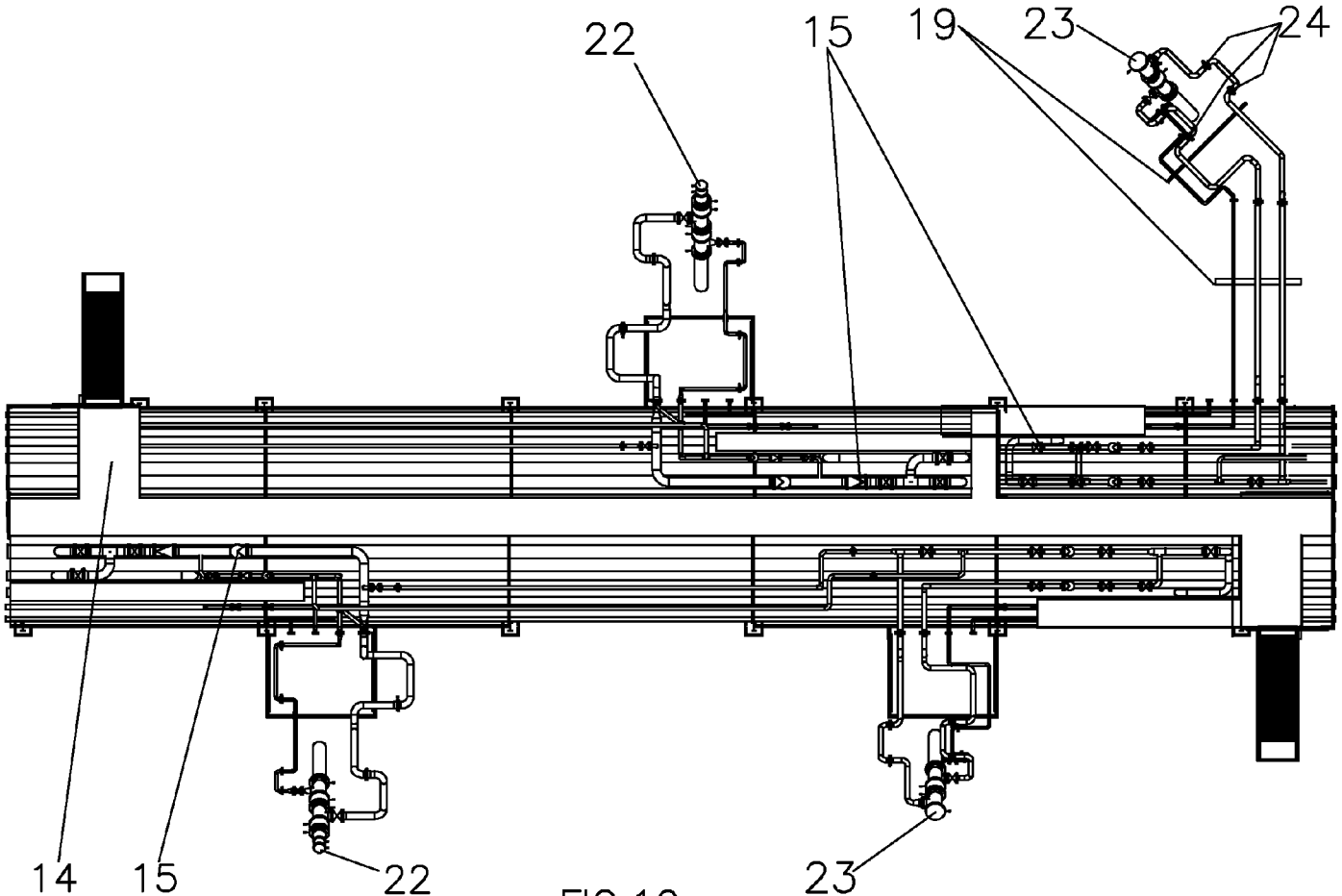
FIG. 10 is a multiple basic platform unit for 4 wells connection.

FIG. 10 shows a multiple basic platform unit for 4 wells connection as a top view of the basic unit of FIG. 4B. The injection wells 23 and the production wells 22 are connected using flexible joints in a similar way as described in FIG. 9. The flexible joints includes swivels 24 and are supported on steel supports 19. A walk-way in the middle of the module 14 allows an easy access to the valves, flow equipment and instrumentation in areas 15. Stairs can be installed from both sides of the unit to allow an easy access and egress to the second level platform. The relatively large size of this unit limited the transportation options.

Figure 6:
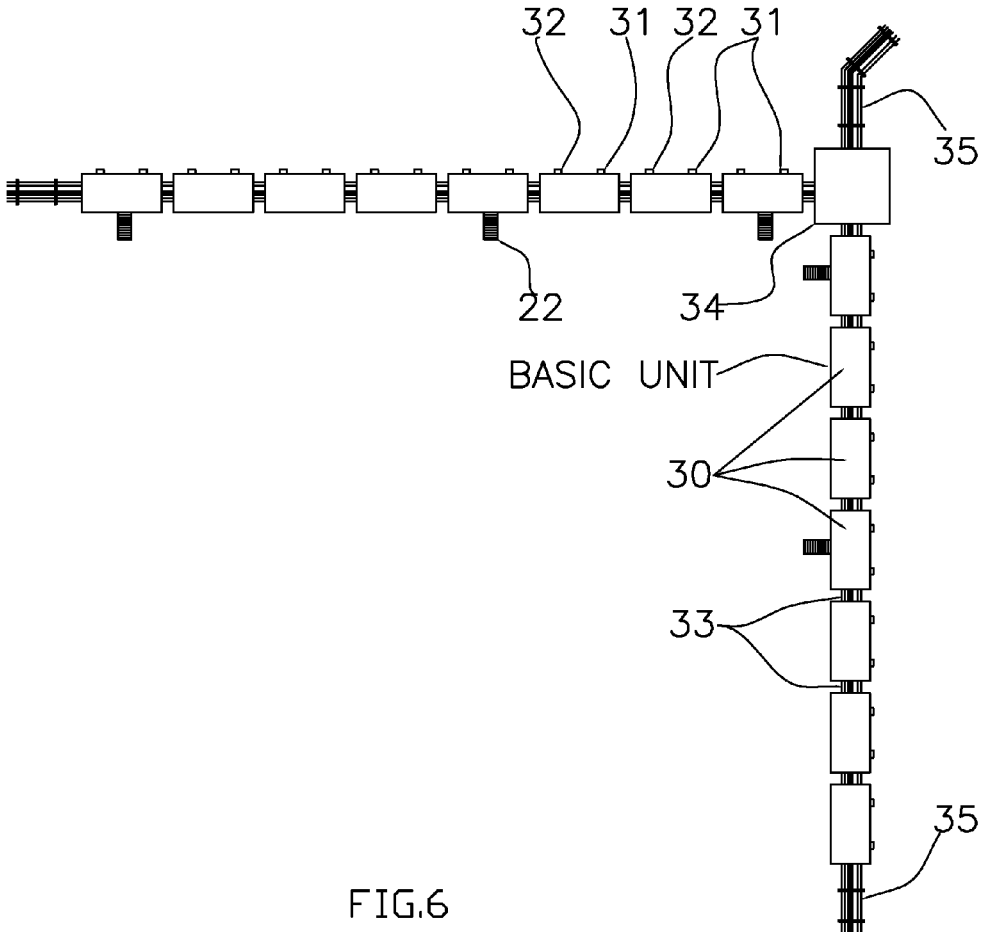
FIG. 6 is a top plan view of a heavy oil well (pad) arrangement using the standard double platforms of the present invention, indicating the isolated view of FIG. 5A.

FIG. 6 shows a typical well site constructed from the basic double platform units that are connected between themselves to a central process area 34 and to the flow lines 35. Each basic double platform unit 30 is connected to two wells—one steam/hydrocarbon injection well 31 and one production well 32. The basic platform units are connected by tie-in welds or by flanges 33 between themselves. A pipeline 35 is connecting the central process area and the main plant. Another option is the connection of this well pad complex through flowing pipeline and electrical cables through the basic platform units 30.

Figure 11:
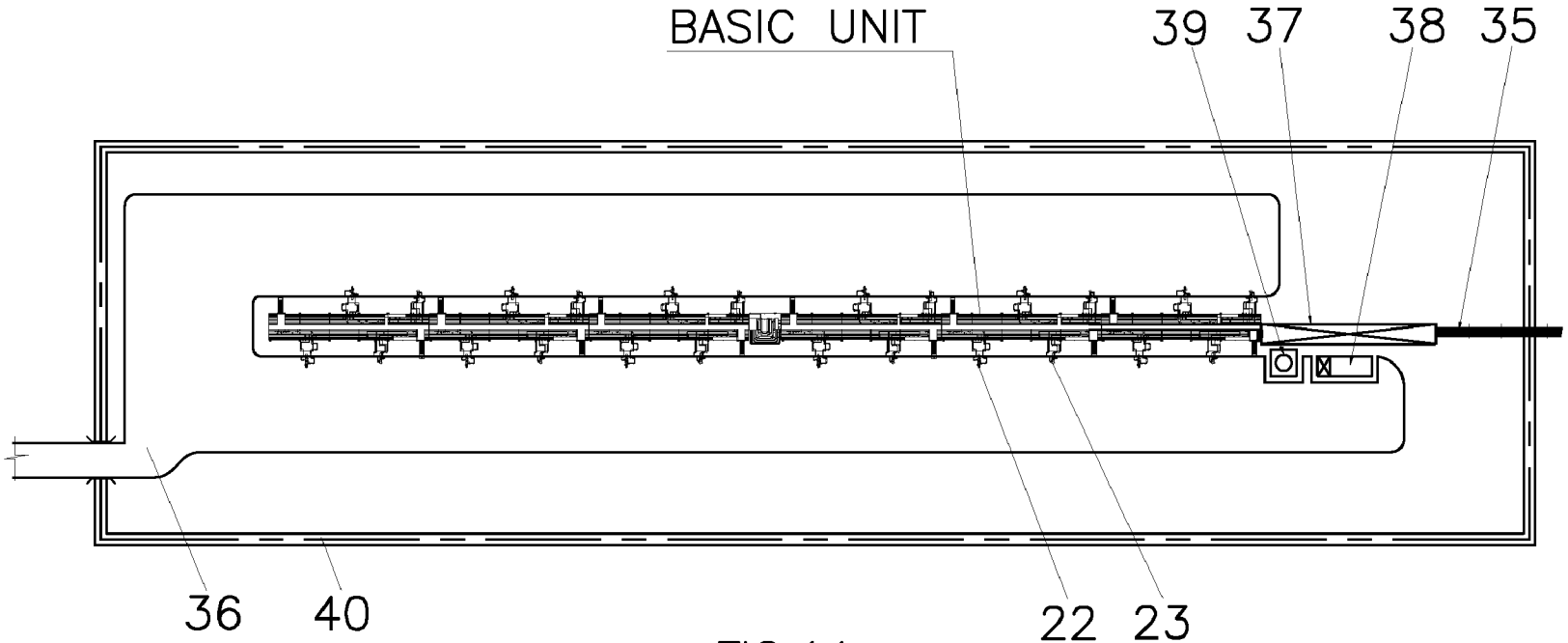
FIG. 11 is a top plan view of a heavy oil well (pad) arrangement using multiple basic platform units for multi wells connection per each platform, indicating the isolated view of FIG. 8.

FIG. 11 shows a typical well site constructed from the multiple type platform units (4 wells per platform) as described in FIG. 10, showing the back-to-back layout view of the unit of FIG. 4. The platform units are connected between themselves, to a central process area 34 and to the flow lines 35. Each basic multi platform unit FIG. 10 is connected to four wells—two steam/hydrocarbon injection well 23 and two production well 22. The basic platform units are connected by tie-in welds or by flanges 33 between themselves. A pipeline 35 is connecting the central process area and the main plant. Another option is the connection of this well pad complex through flowing pipeline and electrical cables through the basic platform units 30.

Figure 7:
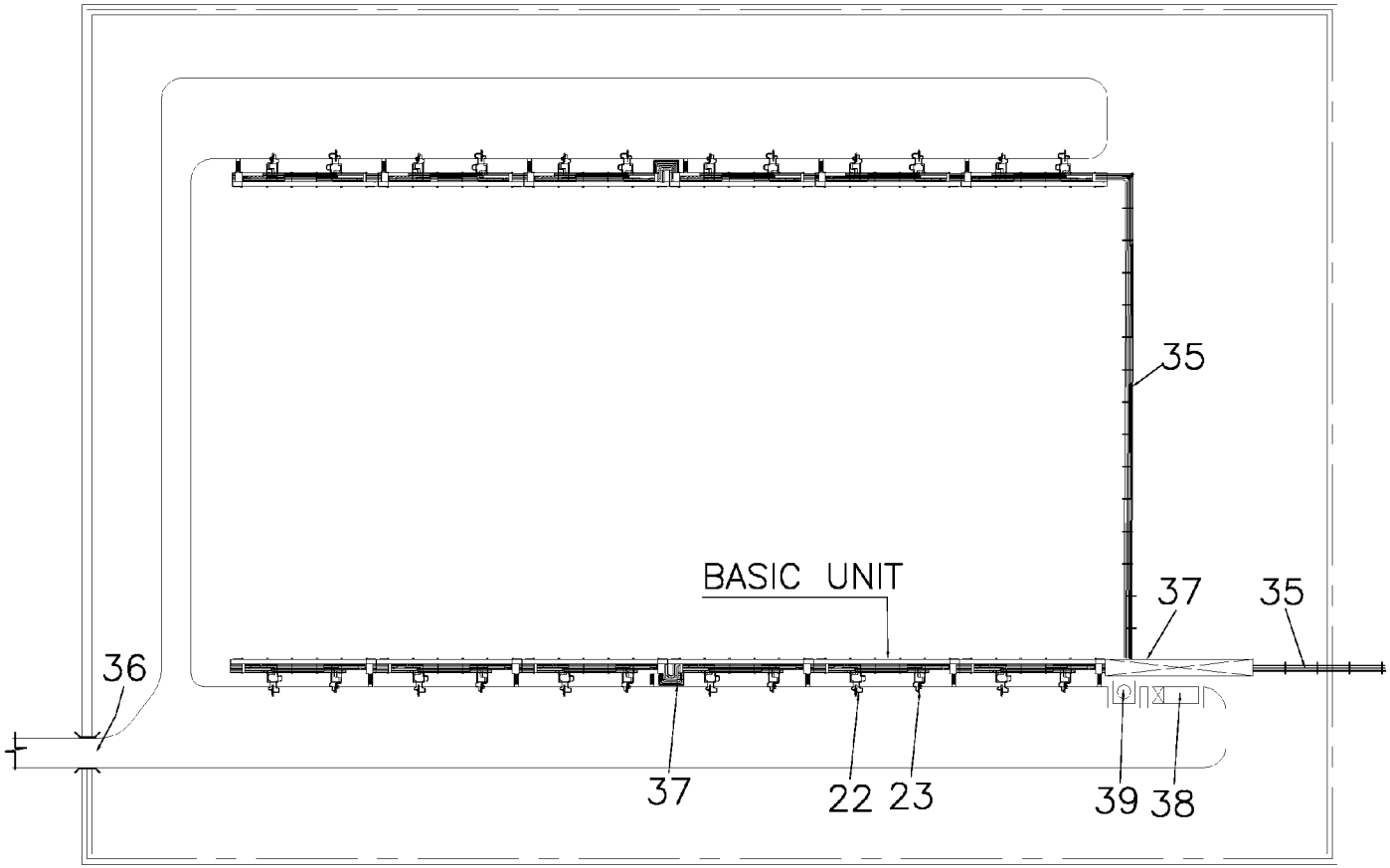
FIG. 7 is another top plan view of a heavy oil well (pad) parallel arrangement using two types of the standard double platforms of the present invention for two (2) pairs of wells.

FIG. 7 shows a typical well site with a parallel basic platform arrangement. In this arrangement, the two rows are connected by flow lines 35. Each unit in each row is identical and connected to the injection well 23 and the production well 22. Another option, which is easier to construct, is to have all the wells in a row for the same purpose. Injection wells 23 are on one row, and production wells 22 are on the other row. In this type of arrangement it is possible to use the basic platform unit for a single well tied together or there is a need for two types of basic double platform units. It is expected that this configuration have an advantage to this type of arrangement by drilling and completing the exact type of wells for the whole line. There is a central process area 37 that is connected via flow lines 35. There is a central process area 37 that is connected via flow lines 35. This pad central process area contains pop tank 39, electric and instrumentation building 38.

Figure 12:
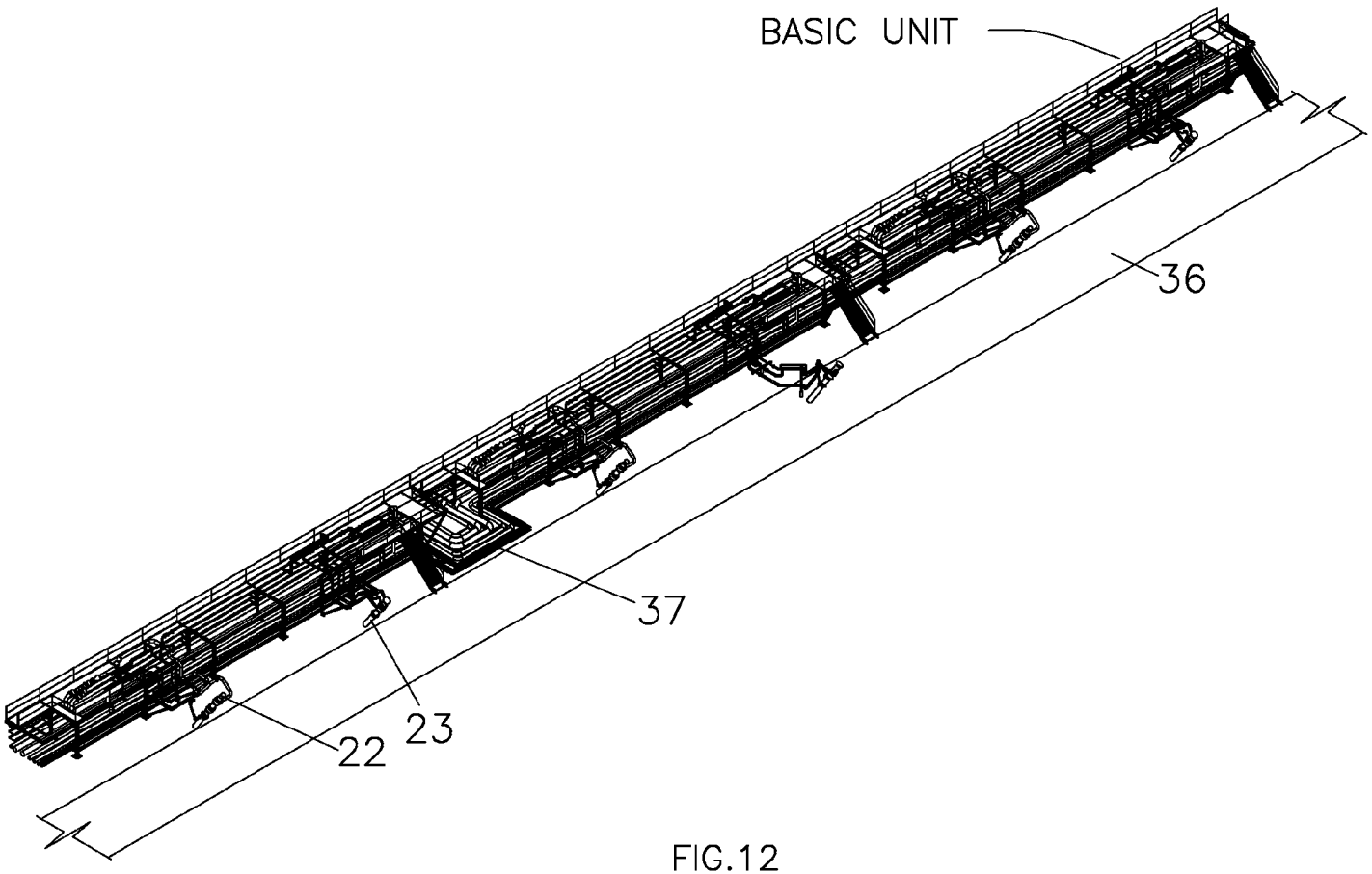
FIG. 12 is an isometric view of four basic platforms connected to a typical SAGD injection and production wells including an expansion loop.

FIG. 12 is an isometric view of four basic platforms with external expansion loop connected to a typical SAGD injection and production wells. This arrangement shows 4 platforms as described in FIG. 9 connected in raw, as based upon the unit of FIG. 5 connected to production and injection well heads. An expansion loop 37 installed in the middle of the platform to compensate for thermal expansion. Injection wells 23 and production wells 22 are connected to the modules. Each unit includes its own stairs for easy access and egress. For maintenance purposes an additional access road is installed in front of the units.

The present invention provides a system and method for the implementation of SAGD technology in a way that reduces cost and schedule risks.

The present invention allows for the connection if flow lines, production wells, injection wells, electric and instrumentation trays, and equipment all together into a standard basic platform unit. These standard basic platform units serve as the basic building block for the entire well field. The basic platform units are designed to be "cookie cut" so as to be built remotely and transported to the site for installation and connection to each other and to the wells.

This SAGD technology includes close wells typically arranged in pairs for steam injection and product collection. Those wells are typically arranged at the field in groups in gathered central locations according to the site bitumen underground formation. However, the present invention is applicable for all types of SAGD-based technologies, including modifications in which wells are gathered or arranged in groups.

The present invention achieves advantages by its ability to combine the equipment, the flow pipes, and the electric and instrumentation trays together into a standard basic platform unit. This avoids the need to construct the pipe separately and connect the system in the field. The construction activity at the field will be to connect the basic platform units to each other.

Each basic platform unit will be of a transportable dimension and it will be produced off-site in a controlled environment at a shop or fabrication yard. Upon completion, the system it will be mobilized for installation in the field. This will result in cost reductions and shorter construction schedules. This is particularly important in view of extreme weather and field work force limitations.

Another advantage for the basic platform units over the existing design practices is the ability to minimize the hydro-testing required on the pipe on site. The present invention has replaced most of these hydro-tests for the pipe constructed on site with flange connections and closure welds so as to avoid the environmental implications, the cost, and scheduling disadvantages of conducting the hydro-test with a water-glycol mixture.

Another advantage of the basic platform unit of the present invention is the ability to relocate to a different location simply by cutting and rewelding the closure welds at the new location. The use of the basic platform units will result in a dramatic reduction of relocation costs and the time required for such activities. This will allow the use of the basic platform units on different locations after the underground bitumen deposit has become depleted.

It is important to note that, in the present invention, the pipe between the units is located at the lowest point possible. Typically, the welding of the pipe that was already hydro-tested using connection welds is a work intensive field task. The location of the pipe at the lowest possible point eliminates the need for scaffolding, reduces the safety issues, increases the productivity, and reduces the cost.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A system for heavy oil production comprising:

a first well having a well head;

a second well having a well head;

a first means connected to said well head of said first well, said first means for injecting steam into said first well; and a second means connected to said well head of said second well for producing heavy oil from said second well, said first and second means arranged in parallel flow relationship, each of said first and second means comprising:

a first level having a plurality of flow lines extending therealong, said flow lines being exposed on opposite sides thereof; and a second level located above said first level, said second level having piping connected to said flow lines of said first level, said second level having a valve and controller cooperative with said piping, said second level supporting cable trays receiving electrical and communication cables thereon, said piping having a swivel head connection suitable for joining to the well head or to a swivel head of an adjacent piping.

2. The system of claim 1, said second level having a walkway formed thereon.

3. The system of claim 2, further comprising:

a stairway extending from said first level upwardly to said walkway of second level.

4. A system for heavy oil production comprising:

a first piping assembly having a first level and a second level, said first level having a plurality of flow lines extending longitudinally therealong, said second level having a piping thereon in communication with said flow lines of said first level, said second level located above said first level, said first and second levels of said first piping assembly are simultaneously transportable and supported by a single frame; and a second piping assembly having a first level and a second level, said first level of said second piping assembly having a plurality of flow lines extending longitudinally therealong, said second level of said second piping assembly having a piping thereon in communication with said flow lines of said first level of said second piping assembly, said first and second levels of said second piping assembly are simultaneously transportable and supported by a single frame, said piping of said second piping assembly selectively connected to said piping of said first piping assembly, said first piping assembly being joined in end-to-end relationship with said second piping assembly and being formed into a string of basic units connected to each other with said flow lines, each unit being parallel to a line of injection or production wells and having connection pipes perpendicular to said line of injection or production wells.

5. The system of claim 4, said plurality of flow lines of each of said first and second piping assemblies being exposed on opposite sides thereof.

6. The system of claim 4, said piping of one of said first and second piping assemblies having a swivel connection thereon suitable for connection to a well head.

7. The system of claim 4, said second level of each of said first and second piping assemblies having valves and controllers interactive with said piping.

8. The system of claim 4, said second level support cable trays thereon receiving electrical and communications cable thereon, the electrical and communication cable of said second level of one of said first and second piping assemblies being connectable to the electrical and communication cables of the second level of the other of said first and second piping assemblies.

9. The system of claim 4, the second level of each of first of said piping assemblies having a walkway thereon, the walkways being aligned and continuous with each other.

10. The system of claim 9, further comprising:

a stairway extending from said first level of said first piping assembly to said walkway of said second level of said first piping assembly.

11. A method of installing piping systems for heavy oil production comprising:

forming a first platform having a first level and second level with flow lines extending along said first level and piping communicating with said flow lines and extending along said second level, said first platform constructed from a single frame, said first and second levels of said first platform being simultaneously transportable;

forming a second platform having a first level and second level with flow lines extending along said first level and piping communicating with said flow lines and extending along said second level, said second platform constructed from a single frame, said first and second levels of said second platform being simultaneously transportable;

transporting said first and second platforms to first and second well heads;

connecting said piping of said second platform to the piping of said first platform;

connecting said piping of said first platform to the first well head; and connection said piping of said second platform to the second well head.

12. The method of claim 11, further comprising:

forming a third platform having a first level and a second level with flow lines extending along said first level and piping communicating with said flow lines;

forming a fourth platform having a first level and a second level with flow lines extending along said first level and piping communicating with said flow lines and extending along said second level;

transporting said third and fourth platforms to third and fourth well heads;

connecting said piping of said third platform to said piping of said second platform;

connecting said piping of said fourth platform to said piping of said third platform; and connecting said piping of said third and fourth platforms to the third and fourth well heads.

13. The method of claim 12, further comprising:

arranging said third and fourth platforms so as to be in parallel flow relationship with respect to said first and second platforms.

14. The method of claim 12, said first well head being a production well, said second well head being an injection well.

15. The method of claim 11, said step of forming comprising:

extending cables along cable trays on said second level of said first platform;

extending cables along a cable tray on said second level of said second platform; and connecting the cables of said first platform with the cables of said second platform through a connection box.

16. The method of claim 11, said first and second platforms having substantially identical configurations.

17. The method of claim 11, said step of connecting said piping of said first platform to said first wellhead comprising:

forming a swivel head on said piping of said first platform.

* * * * *